United States Patent [19]

Miyatuka

[11] 3,969,113

[45] July 13, 1976

[54] PHOTOSENSITIVE BINDER LAYER FOR XEROGRAPHY CONTAINING TITANIUM OXIDE AND A CADMIUM PIGMENT

[75] Inventor: Hajime Miyatuka, Asaka, Japan

[73] Assignee: Rank Xerox Ltd., London, England

[22] Filed: July 23, 1973

[21] Appl. No.: 381,819

Related U.S. Application Data

[62] Division of Ser. No. 193,483, Oct. 28, 1971.

[52] U.S. Cl. ..... 96/1 LY; 96/1.5; 252/501

[51] Int. Cl.[2] ..... G03G 13/10

[58] Field of Search ..... 96/1.5, 1 LY, 1.6; 252/501

[56] References Cited

UNITED STATES PATENTS

| | | | |
|---|---|---|---|
| 3,569,803 | 3/1971 | Sato | 96/1.8 |
| 3,653,895 | 4/1972 | Brandon | 96/1.8 |
| 3,658,523 | 4/1972 | Noe | 96/1.5 |
| 3,682,631 | 8/1972 | Honjo | 96/1.5 |
| 3,705,032 | 12/1972 | Honjo | 96/1.5 |
| 3,706,560 | 12/1972 | Grain | 96/1.5 |

FOREIGN PATENTS OR APPLICATIONS

| | | | |
|---|---|---|---|
| 908,779 | 10/1962 | United Kingdom | 96/1.8 |
| 927,385 | 5/1963 | United Kingdom | 96/1.5 |
| 941,702 | 11/1963 | United Kingdom | 96/1.8 |

*Primary Examiner*—David Klein
*Assistant Examiner*—Judson R. Hightower
*Attorney, Agent, or Firm*—James J. Ralabate; John E. Crowe; James P. O'Sullivan

[57] ABSTRACT

A photoconductive binder layer comprising a particulate mixture of photosensitive titanium dioxide and photosensitive cadmium pigment dispersed in an insulating resin binder.

14 Claims, 2 Drawing Figures

PHOTOSENSITIVE BINDER LAYER FOR XEROGRAPHY CONTAINING TITANIUM OXIDE AND A CADMIUM PIGMENT

BACKGROUND OF THE INVENTION

This application is a divisional application of copending U.S. application Ser. No. 193,483, of Hajime Miytajka, filed on Oct. 28, 1971, and relates to a method for obtaining continuous tone xerographic reproduction.

In the art of xerography, a photosensitive member comprising a binder layer, such as zinc oxide particles dispersed in a film forming insulating resin, is uniformly electrostatically charged in the dark and then exposed to a pattern of activating radiation to form a latent electrostatic image on the surface of the binder layer. This latent image may then be developed by immersing the photosensitive member in a liquid developing solution which contains toner particles. The toner particles are attracted to and adhere to the areas containing the latent electrostatic image. After removal from the developer bath, the photosensitive member is dried and the image fused to form a permanent reproduction of the original radiation pattern or image.

It is well known in the art of xerography that it is difficult to adjust the properties of the photosensitive layer to render it suitable for continuous tone reproduction where the photosensitive layer is imaged in the conventional sequence of charging, exposure, and development with toner. In the art of photography, there are available grades designated No. 1 to No. 5 of printing paper containing a silver halide emulsion layer having the characteristic curve for soft to hard tones. In xerography, however, the conventional photoconductor member is characterized by a straight line in that the characteristic curve is shorter and the incline of the curve usually larger, which means harder. This characteristic curve is prepared by plotting the logarithm of the exposure strength at the abscissa and relative residual potential or developer concentration at the ordinate.

Where a photosensitive layer contains photoconductive particles dispersed in an insulating resin binder, it is known that the incline of the characteristic curve cannot be lagely adjusted, even by changing the ratio of the binder and photoconductive member, or by other process variations in the preparation of the binder layer.

In order to avoid the above problems, the art has adapted various process techniques. One of these comprises a photosensitive layer which is prepared by kneading photosensitive zinc oxide sensitized with pigment absorption, and unsensitized zinc oxide with a binder. This process is more fully described in Japanese Patent Publication No. 11710/1966. U.S. Pat. No. 3,003,870 teaches the use of two kinds of zinc oxide having different sensitivities which are included in a continuous layer. British Pat. No. 967,690 teaches the use of several distinct binder layers sensitized by pigments having different sensitivities.

It can be seen from the above prior art, that complicated manufacturing processes, requiring much labor and resulting in lower efficiency in production, are required in order to obtain photoconductive exhibiting a soft characteristic suitable for continuous tone reproduction.

Conventional xerography is usually used for obtaining a positive image from a positive original. It is well known, however, that positive members usually have rather hard tone. Accordingly, by the use of conventional techniques described above, it is difficult to prepare photoreceptors exhibiting tone soft enough to meet requirements for a continuous tone reproduction.

In general, when using zinc oxide as a photoconductor, it is necessary to charge the photoconductive layer to a negative polarity. Accordingly, photosensitive layers of zinc oxide must use a converted developing polarity in the case of changing an original image from a positive to a negative, due to the affinity of zinc oxide for charges only of negative polarity. In this situation positive development involves floating toner into the latent electrostatic image portion of the photoconductive layer. In negative or reversal development the toner provided with same polarity as the electrostatic latent image. In positive development it is necessary that the developing liquid have a positive polarity and in negative development (reversal development) a developing liquid with negative polarity toner be used.

For both positive and negative development it is necessary to mix different polarity toner into the developing liquid to provide a developer having opposite polarity toners. This requirement results in the deterioration of image quality of the final developed image. On reversal development of a negatively charged photosensitive layer, developing liquid provided with a negative polarity toner could be used. It is, however, difficult to manufacture or obtain developing liquid having a negative polarity toner. Most colored pigment which are used for toner materials, for instance, carbon black or phthalcyanine pigments intrinsically provide positive polarity.

Most resin vehicles which provide negative polarity toner are inconvenient to moisten and are especially difficult to maintain in a stable developing liquid. On the other hand, developing liquid with positive polarity toner is easily obtained. There are, for example, alkyd resins and rosin-modified formaldehyde which are easily dissolved in forming a mentioned developing liquid. In using one kind of developing liquid with positive polarity toner, during development it is desirable to negatively charge photosensitive layer when forming a positive original image and on reversal development it is desirable to positively charge the photosensitive layer when forming a negative original image.

For above mentioned reasons, it is desirable that a photosensitive layer be capable of accepting charge of both positive and negative polarity.

OBJECTS OF THE INVENTION

It is, therefore, an object of the invention to provide a photosensitive binder layer which exhibits soft tone characteristics suitable for reproduction of continuous tone images.

It is another object of this invention to provide a photosensitive material capable of accepting both positive and negative electrostatic charge.

It is a further object of this invention to provide a photosensitive layer suitable for use in liquid development.

SUMMARY OF THE INVENTION

The foregoing objects and others are accomplished in accordance with this invention by providing a novel xerographic binder layer which comprises a particulate mixture of photoconductive titanium dioxide and a photosensitive cadmium pigment or compound contained in a film forming insulating organic resin. The two photoconductive components are homogeneously dispersed in an insulating film forming resin binder which is coated onto any suitable support or substrate to form a photosensitive member. This photosensitive binder layer may be imaged in any conventional xerographic manner. Photosensitive binder layers of the present invention are particularly suitable for continuous tone reproduction and are capable of accepting both positive or negative electrostatic charge.

DETAILED DESCRIPTION OF THE INSTANT INVENTION

Figure 1:
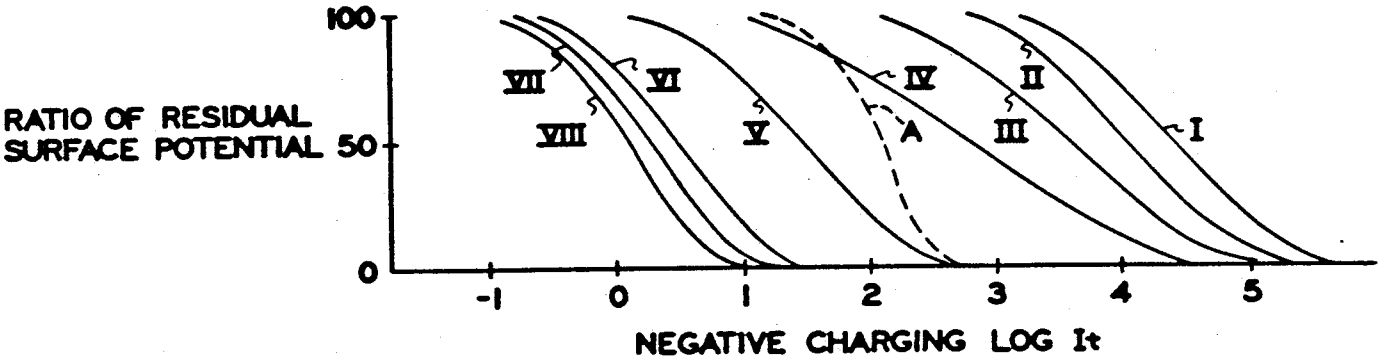
FIG. 1 illustrates characteristic curves obtained when negatively charging photosensitive binder layers of the instant invention as compared to conventional photoconductive binder layers.

The photoconductive composition of the instant invention comprises a photosensitive binder layer in which photosensitive titanium dioxide particles and photosensitive cadmium pigment particles are dispersed in a film forming insulating organic resin. More specifically, rutile-formed titanium is preferable. The ratio of the titanium dioxide to cadmium pigment particles should be from about 50:50 to 99.5:0.5 by weight. A preferred range comprises 70:30 to 99.5:0.5 by weight of titanium dioxide to cadmium pigment.

Any suitable photoconductive cadmium pigment or compound may be used. Typical cadmium or compound pigments include cadmium sulfide; cadmium yellow-orange composed of cadmium sulfide and cadmium carbonate; cadmium yellow-pale or cadmium yellow-light composed of cadmium sulfide and zinc sulfide; cadmium red-orange, cadmium red-light, cadmium red-middle, composed of cadmium sulfide and cadmium selenide; cadmopone lemon added barium sulfide; cadmopone yellow; cadmopone red-light; and cadmopone red-deep.

The weight ratio of the photoconductive pigment mixture-to-insulating resin binder should range from about 2:1 to 15:1 with a preferred range of from about 4:1 to 8:1. In general, any suitable film forming insulating organic resin may be used as the binder material in the instant invention. Typical resins include alkyd resins, copolymers of chloride vinyl and acetate vinyl, apoxy esters, polyisocynate resins, polyester and vinyl copolymers and silicone resins.

If a photosensitive cadmium compound is used alone as the photosensitive material, the light sensitivity is extremely high and in the order of 10 to 100 times greater than that of conventional photosensitive zinc oxide, and about 1,000 to 10,000 times greater than titanium dioxide when compared to photosensitive layers under the same conditions. This potentially means that photosensitive cadmium compounds or pigments when used alone need an exposure only 1/10 to 1/100 of that required for zinc oxide or 1/1,000 to 1/10,000 of titanium dioxide in order to have the same residual potential. The initial absorbing sensitivity of zinc oxide exists in a visible region near about 3840 angstroms, the titanium dioxide at about 4100 angstroms. The absorbing sensitivity of most cadmium pigments, such as cadmium sulfide, are in the visible region at about 6000 angstroms.

Tables I and II below list a grouping of cadmium pigments suitable for use in the instant invention.

TABLE I

| Cadmium Material | Color Tone | CdS(%) | CdSe | $BaSO_4$ |
|---|---|---|---|---|
| cadmium red-orange | reddish orange | 82.0 | 18.0 | — |
| cadmium red-light | light red | 68.8 | 31.2 | — |
| cadmium red-middle | dark red | 57.8 | 42.2 | — |
| cadmium red-malon | malon color | 50.4 | 49.6 | — |
| cadmopone red-light | red | 28.4 | 12.2 | 59.4 |
| cadmopone red-deep | deep red | 25.7 | 16.4 | 58.9 |

TABLE II

| Cadmium Material | Tone | CdS | ZnS | $CdCO_3$ | $BaSO_4$ |
|---|---|---|---|---|---|
| cadmium yellow pale | blue yellow | 74.2 | 25.8 | — | — |
| cadmium yellow light | light yellow | 87.8 | 12.2 | — | — |
| cadmium yellow middle | dark yellow | 100.0 | — | — | — |
| cadmium yellow orange | yellow orange | 44.7 | — | 55.3 | — |
| cadmopone lemon | blue yellow | 29.2 | 4.2 | — | 66.6 |
| cadmopone yellow | yellow | 34.8 | — | — | 65.2 |

Titanium oxide can provide a photosensitive layer capable of accepting charge of both positive and negative polarity. However, titanium dioxide exhibits low sensitivity only 1/100 that of electrofax paper employing zinc oxide contained in a binder.

By using the above-defined mixing ratio of zinc oxide and cadmium pigment, it is possible to make photosensitive layer capable of accepting positive and negative charge.

Photosensitive layers of this invention exhibit a soft-tone characteristic that is suitable for the reproduction of continuous tone images. This property cannot be found in conventional photosensitive materials composing mainly zinc oxide contained in an insulating binder.

DESCRIPTION OF THE PREFERRED EMBODIMENTS

The following examples further specifically define the present invention with respect to a method of making a photosensitive binder layer having soft characteristics suitable for use in continuous tone reproduction and being capable of accepting electrostatic charges of both positive and negative polarity. The percentages in the specification, examples and claims are by weight unless otherwise indicated. The examples below are intended to illustrate various preferred embodiments of the instant invention.

EXAMPLE 1

Eight xerographic plates containing various ratios of titanium dioxide and cadmium yellow-orange photoconductive pigment, listed in Table II, are prepared by the following technique. 900 parts by weight of the photoconductive pigment (i.e. titanium dioxide alone, or mixed with cadmium yellow-orange — colored [2CdS: 3CdCO3]) are mixed with 60 parts by weight of a styrene alkyd resin (hydroxal value of about 50) and 40 parts by weight of polyisocyanate resin (condensed matter of tymethylolpropane, 1 mol, and tolylene diisocyanate, 3 mol). This mixture is dispersed to form a binder solution in n-butylacetate as a solvent. This dispersion is mixed in a ball mill for about 10 hours to form a homogeneous coating solution. Coatings are formed of the eight different mixtures by flow coating the solution onto an aluminized Mylar substrate and left to dry for a day at 40°C in order to promote the hardening reaction of the resin. The dried binder coatings are about 20 microns thick. The characteristic curve for each of the above binder plates is then measured as follows:

The dark decay properties are measured by storing the plate in the dark for 2 days and then charged with negative corona. Secondly, light decay properties are measured by exposing the charge photosensitive material to light in different illuminations made by cutting part of the plate and combining with an N. D. filter with a C light source. The characteristic curve is obtained as follows: The log 1/It is plotted on the abscissa and the potential retentive ratio $([V_L/V_o]/[V_o/V_o'])\times 100$ percent on the ordinate axis. $V_L$ designates the potential after irradiation and intensity I for a constant exposure time of t seconds; $V_o$, is the potential prior to the initiation of irradiation, $V_o'$ is the initial potential at a measurement of dark decay; and $V_o$, the potential dark decay for t seconds.

The measurement of the ordinate axis is read as log 1/It 20 being identified with 100 percent. An initial potential $V_o^D$ the residual ratio of dark decay potential in air $(V^D_{60}/V^D_O)\times 100$ (%): residual ratio of dark decay potential in liquid $(V^D_{60}N^D_O)\times 100$ (%) obtained by wetting a charged plate or sheet in purified decaline insulating liquid capable of converting carrier solution of developer with a voltameter measuring probe thereon.

Figure 2:
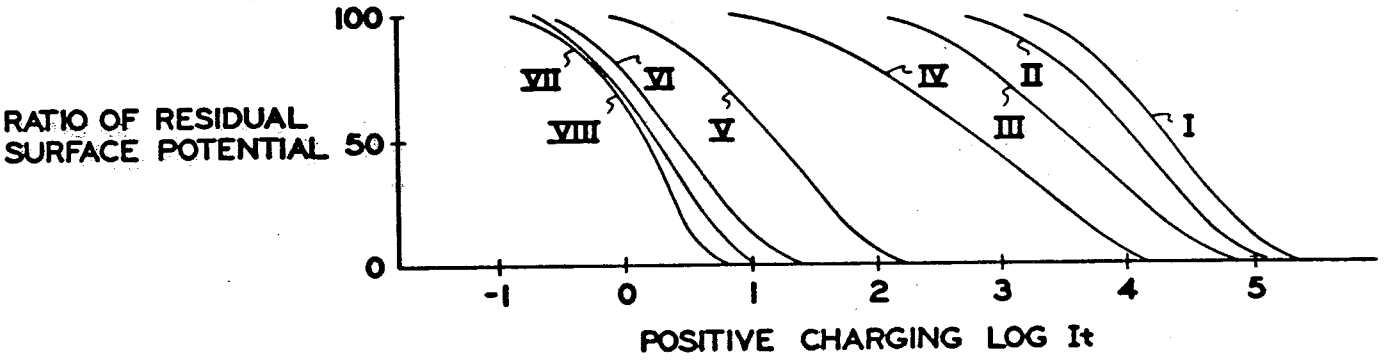
FIG. 2 illustrates the characteristic curves obtained when positively charging photoconductive binder layers of the instant invention.

In Table III below are listed the measurement results for the particular compound according to Example 1 as plates or sheets I–VIII, inclusive.

sensitivity increases in accordance with the increase in mixing ratio in the cadmium orange-yellow-orange (2CdS: 3CdCO3). In proportion to the increase in the mixing ratio of 2Cds: 3CdCO3, the graduation of photosensitive layer becomes soft-tone. When the mixing ratio of cadmium yellow-orange is over 20 percent by weight. Sensitivity varies widely in the range of mixing ratio of 2CdS: 3CdCO3 in 0.5 to 20 weight percent range. There is no significant difference in positive and negative charging with regard to the charging property drawn in Table III and to the characteristic curves in FIGS. 1 and 2.

In the characteristic curve according to negative charging described in Table III, the line indicates characteristic curve A of a photosensitive layer utilizing conventional zinc oxide contained in a silicone resin binder. The graduation of this zinc oxide layer is more hard than any photosensitive layer of the instant invention.

EXAMPLE 2

A second series of plates or sheets similar to those formed in Example 1 are formed by the method of Example 2 using a titanium dioxide and cadmium yellow-pale (3Cd:ZnS). The photoconductive mixture comprises 850 parts by weight which is mixed with a chloride acetate copolymer resin (chloride vinyl 1 acetate vinyl = 60/40) in a concentration of 150 parts per weight. The titanium dioxide/cadmium yellow-pale mixing ratio for the six samples made is 99.5 to 0.5; 99.0 to 1.0; 70 to 30, 90 to 10, 80 to 20; and 70 to 30 by weight. When these plates are tested electrically, they exhibit the same results as observed for plates I-VIII of Example 1. Furthermore, no significant difference can be found between negative and positive charging.

Other modifications and ramifications of the present invention appear to those skilled in the art upon reading the disclosure. These are also intended to be within the scope of this invention.

What is claimed is:

1. In a method for obtaining continuous tone xerographic reproduction by liquid developing an electrostatically charged and exposed photoconductive binder layer, the improvement comprising utilizing as photo-

TABLE III

| Weight Mixing Ratio | | | Positive Charge | | | Negative Charge | | |
|---|---|---|---|---|---|---|---|---|
| Titanium Oxide | | Cadmium Yellow-Orange | Initial Potential $V_o^D$ | Residual Potential Ratio $(V_{60}^D/V_o^D)\times 100$ | Residual Potential Ratio In Liquid $(V_{60}^D/V_o^D)l\times 100$ | Initial Potential Ratio $V_o^D$ | Residual Potential Ratio $(V_{60}^D/V_o^D)\times 100$ | Residual Potential Ratio In Liquid $(V_{60}^D/Vo^D)l\times 100$ |
| I | 100wt% | Owt% | +160volt | 90% | 91% | −180volt | 87% | 88% |
| II | 99.5 | 0.5 | +160 | 91 | 90 | −190 | 86 | 86 |
| III | 99.0 | 1.0 | +150 | 90 | 87 | −180 | 84 | 83 |
| IV | 97.0 | 3.0 | +160 | 88 | 88 | −170 | 82 | 80 |
| V | 90.0 | 10.0 | +150 | 83 | 85 | −160 | 80 | 75 |
| VI | 80.0 | 20.0 | +130 | 80 | 83 | −140 | 75 | 70 |
| VII | 70.0 | 30.0 | +100 | 73 | 78 | −100 | 72 | 68 |
| VIII | 60.0 | 40.0 | +40 | 33 | 43 | −30 | 30 | 22 |

According to Table III, the initial charging potential and residual ratio of potential decrease rapidly where the mixing ratio of the cadmium yellow-orange exceeds 30 weight percent. In the drawings, FIGS. 1 and 2 designate a characteristic curve for the photosensitive materials of sheets I-VIII, inclusive, charged positively or negatively. For both positive and negative charging, conductive binder layer a particulate mixture essentially comprising titanium oxide and cadmium pigment in a film forming electrically insulating organic resin, the ratio of titanium-to-cadmium pigment being 50:50 to about 99.5:0.5 by weight and the weight ratio of pigment-to-resin binder ranging from about 2:1 to 15:1.

2. The method of claim 1 in which the cadmium pigment comprises cadmium sulfide.

3. The method of claim 1 in which the resin binder is contained on a supporting substrate.

4. The method of claim 1 in which the titanium oxide pigment is of the rutile type.

5. The method of claim 1 in which the weight ratio of titanium oxide to cadmium pigment is from 70:30 to 99.5:0.5.

6. The method of claim 1 in which the weight ratio of the photoconductive pigment-to-resin binder ranges from about 4:1 to 8:1.

7. The method of claim 1 in which the resin binder contains at least one of an alkyd resin, a polyisocyanate resin or a silicone resin.

8. The method of claim 7 in which the binder layer comprises titanium dioxide and cadmium yellow-orange pigments admixed with a styrene alkyd-and polyisocyanate-resin binder.

9. The method of claim 8 in which the ratio of titanium oxide-to-cadmium pigments is about 80:20 weight percent.

10. The method of claim 8 in which the ratio of titanium oxide-to-cadmium pigments is about 90:10 weight percent.

11. The method of claim 8 in which the ratio of titanium oxide-to-cadmium pigments is about 99.0:1 weight percent.

12. The method of claim 1 in which the binder layer contains a titanium oxide component in combination with a pigment component selected from the group consisting of a. cadmium red-orange containing cadmium sulfide and cadmium selenide;

b. cadmium red-light containing cadmium sulfide and cadmium selenide;

c. cadmium red-middle containing cadmium sulfide and cadmium selenide;

d. cadmium red-malon containing cadmium sulfide and cadmium selenide;

e. cadmopone red-light containing cadmium sulfide, cadmium selenide and barium sulfate;

f. cadmopone red-deep containing cadmium sulfide, cadmium selenide and barium sulfate;

g. cadmium yellow pale containing cadmium sulfide and zinc sulfide;

h. cadmium yellow-light containing cadmium sulfide and zinc sulfide;

i. cadmium yellow-middle containing cadmium sulfide;

j. cadmium yellow-orange containing cadmium sulfide and cadmium carbonate;

k. cadmopone lemon containing cadmium sulfide, zinc sulfide and barium sulfide; and l. cadmopone yellow containing cadmium sulfide and barium sulfate;

the ratio of titanium oxide-to-pigment component in the binder layer being 50% – 99.5% titanium component by weight: 50% – 0.5% pigment by weight respectively.

13. The method of claim 12 wherein the ratio of titanium oxide-to-cadmium yellow pale pigment is about 80:20 weight percent respectively.

14. The method of claim 12 wherein the ratio of titanium oxide-to-cadmium yellow pale pigment is about 90:10 weight percent respectively.

* * * * *

UNITED STATES PATENT AND TRADEMARK OFFICE

CERTIFICATE OF CORRECTION

PATENT NO. : 3,969,113

DATED : July 13, 1976

INVENTOR(S) : Hajime Miyatuka

It is certified that error appears in the above-identified patent and that said Letters Patent are hereby corrected as shown below:

Column 1, line 47, delete "lagely" and insert --largely--.

Column 2, line 34, delete "phthalcyanine" and insert --phthalocyanine--.

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*